US009788657B2

(12) United States Patent
Chen

(10) Patent No.: US 9,788,657 B2
(45) Date of Patent: Oct. 17, 2017

(54) CHAIR TRAY AND CHASSIS, CHASSIS FORMING METHOD AND CHASSIS MOUNTING STRUCTURE OF THE SAME

(71) Applicant: ZHONGWEI HOLDING GROUP CO., LTD, Wenzhou (CN)

(72) Inventor: Qiankui Chen, Wenzhou (CN)

( * ) Notice: Subject to any disclaimer, the term of this patent is extended or adjusted under 35 U.S.C. 154(b) by 29 days.

(21) Appl. No.: 15/008,455

(22) Filed: Jan. 28, 2016

(65) Prior Publication Data

US 2017/0164749 A1 Jun. 15, 2017

(30) Foreign Application Priority Data

Dec. 9, 2015 (CN) ..... 2015 1 0903378

(51) Int. Cl.

| | |
|---|---|
| ***A47C 31/00*** | (2006.01) |
| ***A47C 7/56*** | (2006.01) |
| ***A47C 7/00*** | (2006.01) |
| ***B21D 28/32*** | (2006.01) |

(52) U.S. Cl.

CPC ..... *A47C 7/566* (2013.01); *A47C 7/002* (2013.01); *A47C 7/563* (2013.01); *B21D 28/32* (2013.01)

(58) Field of Classification Search

CPC ..... A47C 1/03266; A47C 7/441; A47C 7/446

USPC ..... 297/463.1, 303.3, 303.2

See application file for complete search history.

(56) References Cited

U.S. PATENT DOCUMENTS

| | | | | |
|---|---|---|---|---|
| 2,729,273 A * | 1/1956 | Hamilton | A47C 7/441 | 248/576 |
| 4,720,142 A * | 1/1988 | Holdredge | A47C 1/03255 | 297/293 |
| 4,865,384 A * | 9/1989 | Desanta | A47C 1/03255 | 297/300.4 |
| 4,906,045 A * | 3/1990 | Hofman | A47C 3/026 | 248/609 |

(Continued)

FOREIGN PATENT DOCUMENTS

| | | |
|---|---|---|
| CN | 201170650 Y | 12/2008 |
| CN | 201519244 U | 7/2010 |

(Continued)

OTHER PUBLICATIONS

First Office Action of CN201510903378.7.
Search report of CN201510903378.7.

*Primary Examiner* — Jose V Chen
(74) *Attorney, Agent, or Firm* — Wayne & Ken, LLC; Tony Hom

(57) ABSTRACT

The present disclosure relates to a chair tray and chassis, chassis forming method and chassis mounting structure of the same. The chair chassis comprises a chassis body that is arranged with a mounting hole thereon for mounting a regulating knob. The edge at the position corresponding to the mounting hole of the chassis body is arranged with a flange. The structural strength and the fatigue strength of the chassis can be enhanced effectively by arranging the flange at the position corresponding to the mounting hole of the chassis, which avoids the occurrence of fracture at the perimeter of the mounting hole of the chassis during use or test and thus enables the thickness of the chassis to be reduced below 3 mm, reducing production material to a very large extent and saving production cost while also ensuring (Continued)

that it can pass the back pad fatigue test in the BIFMA standard.

7 Claims, 8 Drawing Sheets

(56) References Cited

U.S. PATENT DOCUMENTS 5,029,940 A * 7/1991 Golynsky ..... A47C 3/026 297/300.4
5,114,211 A * 5/1992 Desanta ..... A47C 1/03255 297/300.4
5,630,647 A * 5/1997 Heidmann ..... A47C 1/023 297/303.1
5,909,924 A * 6/1999 Roslund, Jr. ..... A47C 1/03255 297/300.4
5,915,788 A * 6/1999 Schneider ..... A47C 1/03255 297/301.3
6,022,077 A * 2/2000 Kirkland ..... B63B 29/06 248/404
6,116,695 A * 9/2000 Heidmann ..... A47C 1/023 297/285
6,231,126 B1 * 5/2001 Cheng ..... A47C 3/00 297/326
6,290,296 B1 * 9/2001 Beggs ..... A47C 3/30 248/205.3
6,352,308 B1 * 3/2002 Chen ..... A47C 7/004 248/188.1
6,523,897 B2 * 2/2003 Pan ..... A47C 1/022 297/300.2
6,582,019 B2 * 6/2003 Insalaco ..... A47C 1/03255 297/300.1
6,585,320 B2 * 7/2003 Holbrook ..... A47C 3/026 297/300.4
7,069,865 B2 * 7/2006 Strong ..... A47B 3/087 108/115
7,111,563 B2 * 9/2006 Strong ..... A47B 3/087 108/129
7,171,910 B2 * 2/2007 Neunzert ..... A47B 3/087 108/115
7,293,832 B2 * 11/2007 Huang ..... A47C 1/03238 297/300.7
2002/0096933 A1 * 7/2002 Wang ..... A47C 3/30 297/463.1
2002/0163242 A1 * 11/2002 Beggs ..... A47C 1/026 297/463.1
2004/0183351 A1 * 9/2004 Johnson ..... A47C 1/03255 297/302.3
2006/0022508 A1 * 2/2006 Lin ..... A47C 1/024 297/463.2
2011/0109135 A1 * 5/2011 Davis, Jr. ..... A47C 3/18 297/217.4
2011/0241405 A1 * 10/2011 Slagh ..... A47C 1/023 297/463.1
2012/0025587 A1 * 2/2012 Zanchetta ..... A47C 7/004 297/463.1
2013/0234485 A1 * 9/2013 Gorgi ..... A47C 1/03238 297/303.2
2014/0028069 A1 * 1/2014 Weiss ..... A47C 3/18 297/344.21
2014/0167483 A1 * 6/2014 Schneider ..... B60N 2/06 297/463.1
2016/0200222 A1 * 7/2016 Desquesne ..... B60N 2/2252 297/354.12

FOREIGN PATENT DOCUMENTS

CN 102090805 A 6/2011
CN 202739346 U 2/2013
CN 203435987 U 2/2014
CN 205568397 U 9/2016
JP 2004-33449 A 5/2004

* cited by examiner

CHAIR TRAY AND CHASSIS, CHASSIS FORMING METHOD AND CHASSIS MOUNTING STRUCTURE OF THE SAME

CROSS-REFERENCE TO RELATED APPLICATIONS

This application is a continuation of and claims foreign priority of Chinese Patent Application No. 201510903378.7 which filed Dec. 9, 2015. The contents of the aforementioned application, including any intervening amendments thereto, are incorporated herein by reference.

TECHNICAL FIELD

The present invention is related to the field of chairs, in particular to a chair tray and chassis, chassis forming method and chassis mounting structure of the same.

BACKGROUND

Lifting and leaning chairs, because of their adjustable heights, can be adapted to people having different heights and also to worktables of different heights for use, and can increase the level of comfort for people using them. As a result, their range of use is getting wider and wider and the number of people using them is becoming larger and larger.

The prior art such as the Chinese patent No. 200910249643.9 discloses a chair chassis with adjustable leaning force. It comprises a middle plate and a large plate. The rear part of the large plate can swing downwards relative to the middle plate around a rotary shaft. A regulating knob with a cavity is arranged under the front part of the middle plate. A mounting plate fixed with the regulating knob is arranged within the cavity of the regulating knob, and a worm wheel that is rotatable relative to the regulating knob around its own axis is arranged at the corresponding position of the regulating knob under the mounting plate. A worm engaging with the worm wheel is arranged within the regulating knob at the corresponding position beside the worm wheel. One end of the handle projects into the regulating knob from the outside of the regulating knob to be in transmissive connection with the worm. A regulating bolt, which in turn passes through the large plate, the middle plate and the mounting plate within the regulating knob from top to bottom, matches with the worm wheel by threads. The regulating bolt is coaxial with the worm wheel. A spiral spring is sleeved on the part of regulating bolt that is below the middle plate and above the mounting plate.

When a chair is leant, the spiral spring acts to reset the leant chair and at the same time regulates the extent of compression of the spiral spring by the worm wheel and worm structure in order to achieve the regulation of the chair leaning reset force. However, as the chair is being leant, the regulating bolt swings continuously within the mounting hole and at the same time the screw head of the regulating bolt is in continuous friction with the chassis, causing continuous wear for the chassis and even causing the easy occurrence of cracks at the mounting hole of the chassis during a long period of time in use. Therefore, it can be seen that the mounting hole of the chassis is not strong enough.

At the same time, many chairs also need to be exported to various countries all over the world at present, becoming more internationalized. Therefore, at present an international standard related to office chairs ANSI BIFMA arises, which has specific index and requirement for various performance of chairs, such as back pad static tension test, chassis lock test, chair cushion static shock test, chair cushion fatigue shock test as well as back pad fatigue test, etc. Among others, the test about the back pad fatigue is intended for evaluating the ability of the chair against the fatigue pressure and the wear caused by the force applied backward on the back pad. By applying a force in the vertical direction to the chair cushion and then applying a backward tilting force to the back during the test, the back is caused to tilt backward and reset continuously and cycle like this. During this course, the regulating bolt swings continuously within the mounting hole, causing the occurrence of cracks with the continuous wear at the mounting hole of the chassis. However in the BIFMA standard, a chair is qualified only if it repeats such test for 300 thousand times and no cracks appear, which sets very high requirement for the strength at the mounting hole of the chassis. At present, all chassises on the market process mounting holes directly, such as in the Chinese patent No. 200910249643.9 above. However, in order to undergo tests for up to 300 thousand times in the BIFMA standard, the general thickness of such chassis will be above 3 mm or more, which increases material for the products and further increases production cost. However, if the chassis is reduced below 3 mm in thickness in order to reduce cost, it in turn cannot pass the back pad fatigue test in the BIFMA standard. Therefore, there is a need for further improvement. At present, a difficult problem needed to be overcome is to study a chassis which can both save cost and pass the BIFMA standard.

SUMMARY

The object of the present invention is to provide a chair chassis that can increase mechanical fatigue strength.

The above technical object of the present invention is achieved by the following technical solutions.

A chair chassis comprises a chassis body that is arranged with a mounting hole thereon for mounting a regulating bolt. The edge at the position corresponding to the mounting hole of the chassis body is arranged with a flange.

The present invention is further arranged such that the flange is arranged on a lower surface of the chassis.

The present invention is further arranged such that the flange is arranged on an upper surface of the chassis.

The present invention is further arranged such that the upper surface of the chassis body is arranged with bumps that are arranged at an interval in the direction of the chassis width and distributed at two sides of the mounting hole. The surface of the bump is a cambered face.

Above all, the present invention has beneficial effects as follows. The structural strength and the fatigue strength of the chassis can be enhanced effectively by arranging the flange at the position corresponding to the mounting hole of the chassis to enhance the mechanical strength at the connection between the regulating bolt and the mounting hole, which avoids the occurrence of cracks at the perimeter of the arranged mounting hole of the chassis during use or test as the regulating bolt is in point or line contact with the chassis with the edge of its head, causing concentrated pressure to the perimeter of the mounting hole of the chassis, and furthermore the head of the regulating bolt is in continuous friction with the chassis, causing continuous wear for the chassis. Since the regulating bolt always applies pressure to the chassis during use, in addition by arranging the bumps, the force applied by the regulating bolt compresses the bulge and the arc-shaped bulge renders the received force more scattered and dispersed bilaterally along two arc sides thereof in order to enhance wear resistance ability, enabling the thickness of the chassis to be reduced below 3 mm, reducing production material to a large extent and saving production cost while also ensuring that it can pass the back pad fatigue test in the BIFMA standard.

The object of the present invention is also to provide a forming method of the flange and the bumps on the easily formed chair chassis.

The technical object of the present invention is achieved by the following technical solutions.

The flange is formed by forward punching at the position corresponding to the mounting hole on the upper surface of the chassis.

Then the bumps are formed by reverse punching on the lower surface of the chassis.

The object of the present invention is also to provide a connecting structure between the chassis and the regulating bolt for increasing mechanical fatigue strength.

The technical object of the present invention is achieved by the following technical solutions.

A nylon washer is arranged between the head of the regulating bolt and the chassis. The regulating bolt passes through the nylon washer and the mounting hole of the chassis in turn.

Above all, the present invention has beneficial effects as follows. Nylon material has high mechanical strength, good toughness, higher tensile and compressive strength and at the same time its fatigue resistance is outstanding and it is corrosion resistant and wear resistant, therefore, by arranging the nylon washer 11, protection can be achieved. As a result, utilizing the buffering and high wear resistance of plastic, the connecting structure between the regulating bolt and the chassis avoids the direct contact of the screw head of the regulating bolt 91 with the chassis body 1, and avoids the occurrence of cracks to the chassis body 1. As such, it is more smooth for the chassis below 3 mm to pass the back pad fatigue test in the BIFMA standard at the same time.

The object of the present invention is also to provide a chair tray that can regulate leaning and restoring force.

The technical object of the present invention is achieved by the following technical solutions.

An elastic element and a regulating knob are sleeved on the regulating bolt. The regulating knob is in threaded connection with the regulating bolt, such that when the regulating knob is rotated, the elastic element is compressed to achieve the regulation of the leaning reset force.

The present invention is further arranged such that the chair tray also comprises a middle plate and a rotary rod. The middle plate is arranged with a rotary shaft therethrough, by which it is connected with the chassis. The middle plate is arranged with a via thereon for a gas spring to go through. The rotary rod is arranged with a bend part thereon for linking the gas spring. The rotary rod is arranged with a reset torsional spring thereon that holds the bend part against the gas spring.

The present invention is further arranged such that the rotary rod runs through the middle plate at its end. The sidewall of the chassis is arranged with limiting holes thereon corresponding with the rotary rod.

Above all, the present invention has beneficial effects as follows. On the one hand, firstly the chassis on the chair tray is the one with the flange, therefore the structural strength and the fatigue strength of the chassis can be enhanced effectively, which avoids the occurrence of fracture at the perimeter of the mounting hole of the chassis during use or test and thus enables the thickness of the chassis to be reduced below 3 mm, reducing production material to a very large extent and saving production cost while also ensuring that it can pass the relevant test in the BIFMA standard. On the other hand, the means to regulate the leaning restoring force achieves a simple structure and low cost and moreover omits the addition of other structures and saves the internal space by arranging the bend part directly on the rotary rod and utilizing the linkage between the bending on the rotary rod and the gas spring, thus creating a simple structure. The resilience of the torsional spring can hold the rotary rod tightly against the gas spring, which ensures that the rotary rod does not rotate freely as the chair vibrates and avoids noise caused by the rotation and then collision of the rotary rod. Also, holding the rotary rod against the gas spring reduces the number of the hit by the rotary rod to the gas spring, which makes a higher level of safety and prolongs the lifetime of the equipment. As the torsional spring covers a small space, it can be mounted on the rotary rod directly and the internal space of the middle plate is spacious.

Attached figure signs: 1. chassis body, 2. mounting hole, 3. flange, 31. rounded structure, 4. lower projection, 5. bump, 6. middle plate, 61. rotary shaft, 7. rotary rod, 71. bend part, 72. reset torsional spring, 8. via, 91. regulating bolt, 92. spring, 93. bushing, 94. regulating knob, 10. limiting hole, 11. nylon washer, 12. chair cushion, 13. back.

DETAILED DESCRIPTION

The present invention is further illustrated in details below in connection with the accompanying drawings.

Figure 2:
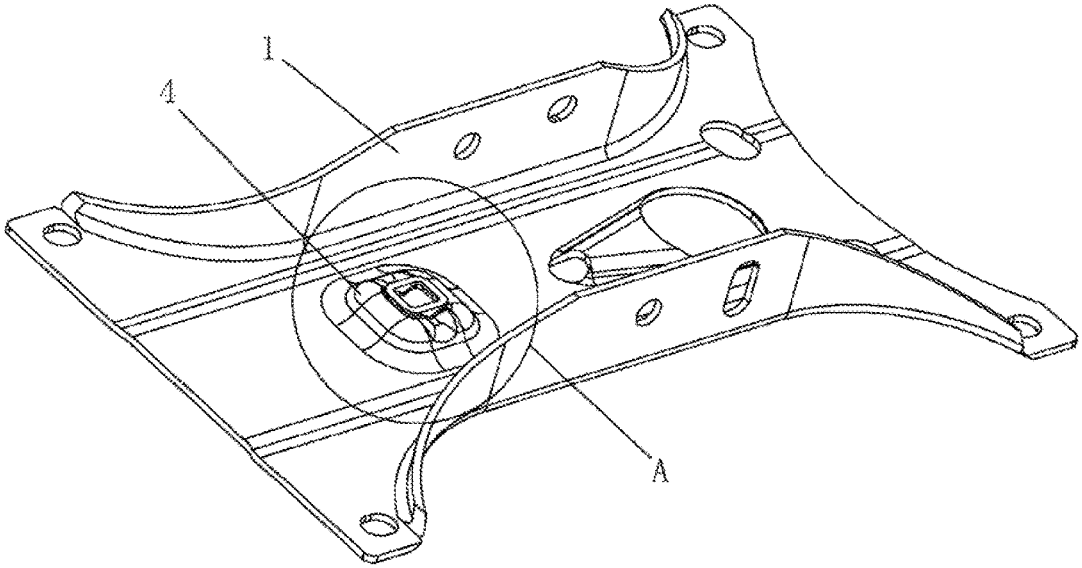
FIG. 2 is a structural schematic diagram of the example chassis from another perspective.
Figure 3:
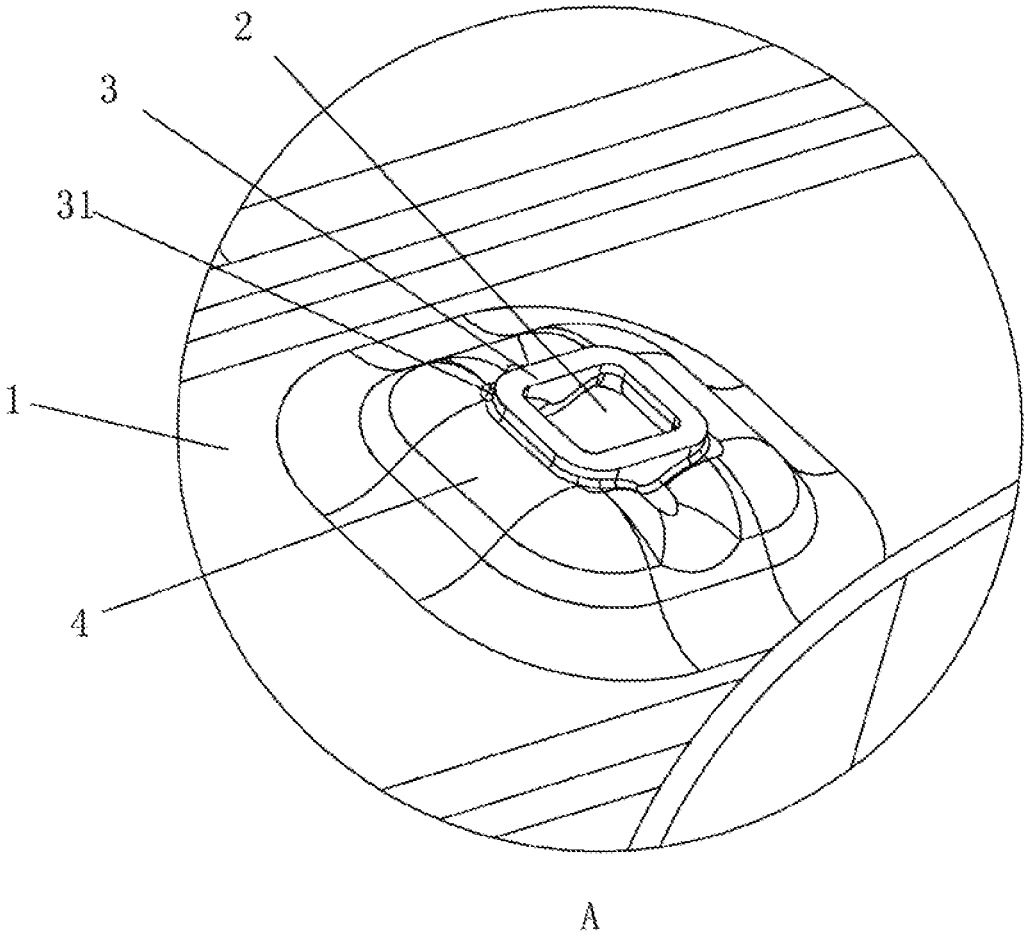
FIG. 3 is an enlarged view of part A in FIG. 2.

As shown in FIGS. 2 and 3, a chassis comprises a chassis body 1 that is arranged with a mounting hole 2 thereon for mounting a regulating bolt 91. The edge at the position corresponding to the mounting hole 2 of the chassis body 1 is arranged with a flange 3, and the flange 3 is a ring edge that surrounds the mounting hole 2.

The structural strength and the fatigue strength of the chassis can be enhanced effectively by arranging the flange 3 at the position corresponding to the mounting hole 2 of the chassis to enhance the mechanical strength at the connection between the regulating bolt 91 and the mounting hole 2, which avoids the occurrence of cracks at the perimeter of the arranged mounting hole 2 of the chassis during use or test as the regulating bolt 91 is in point or line contact with the chassis with the edge of its head, causing concentrated pressure to the perimeter of the mounting hole 2 of the chassis, and furthermore the head of the regulating bolt 91 is in continuous friction with the chassis, causing continuous wear for the chassis. Since the regulating bolt 91 always applies pressure to the chassis during use, when the flange 3 is arranged on the upper surface, the force bearing point is transferred onto the flange 3 and the contact turns from the original point or line contact into face contact, increasing the contact area. When the flange 3 is arranged on the lower surface, not only the mechanical structural strength and the fatigue strength are increased but also in addition by arranging the bumps 5, the force applied by the regulating bolt 91 compresses the bulge and the arc-shaped bulge renders the received force more scattered and dispersed bilaterally along two arc sides thereof in order to enhance wear resistance ability, enabling the thickness of the chassis to be reduced below 3 mm, reducing production material to a large extent and saving production cost while also ensuring that it can pass the back pad fatigue test in the BIFMA standard. Additionally, the fact that the flange 3 surrounds the mounting hole 2 can increase the structural strength and the fatigue strength at the perimeter of the mounting hole 2 of the chassis more all around with a better effect.

The flange 3 and bumps 5 may have a plurality of forming methods during practical processing. For example, a smaller mounting hole 2 may be opened at first on the chassis body 1, followed by a procedure of punching, by which the mounting hole 2 of the chassis body 1 forms flanging (surrounding the inner sides) in the inner wall thereof. Alternatively, the same can also be achieved by processing the flange 3 in advance, followed by a procedure of welding the flange 3 to the mounting hole 2 of the chassis body 1. However, when comparing these two solutions, the former has a simpler production process and can save much unnecessary human resource and furthermore save production cost, and since the flange 3 itself is arranged integral to the chassis body 1, the flange 3 is more firmly connected to the chassis body 1, therefore the structure is more reliable and more aesthetic.

Figure 1:
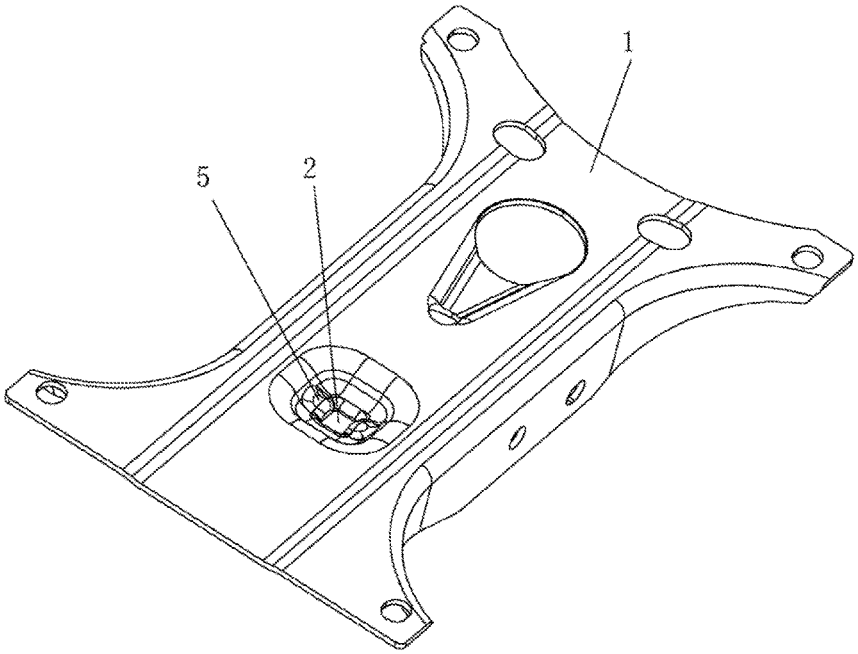
FIG. 1 is a structural schematic diagram of the example chassis.

As shown in FIGS. 1 and 2, the position corresponding to the mounting hole 2 on the outer surface of the chassis body 1 is depressed and forms a lower projection 4 in its inner wall. The mounting hole 2 and the flange 3 are both located on the lower projection 4.

A recess for placing the screw head of the regulating bolt 91 is formed by depressing the chassis body 1 at one side. The recess is formed in a simple manner and just punching can make it, which makes the mounting of the regulating bolt 91 more stable and at the same time can also avoid the occurrence of the screw head of the regulating bolt 91 being higher than the surface of the chassis body 1, ensuring the flatness of the surface of the chassis body 1 and facilitating the connection with the chair cushion 12 to a larger extent. Additionally, the bumps 5 are arranged at the lower depression of the chassis body 1. The bumps 5 are formed by reverse punching from the inner wall of the chassis body 1, which is a simple and convenient forming method. The bumps 5 are arranged at an interval in the direction of the chassis width and distributed at two sides of the mounting hole 2. The arrangement of the bumps 5 at two sides can ensure that the regulating bolt 91 swings back and forth within the mounting hole 2 to achieve leaning of the chair. Additionally, the surface of the bump 5 is a cambered face. As such the bumps 5 are in point contact with the screw head of the regulating bolt 91 and the contact area is smaller, which is more beneficial for the regulating bolt 91 to swing back and forth.

In the chassis, the mounting hole 2 is a square hole, and at the same time the regulating bolt 91 is arranged with a square connecting segment thereon mated with the square hole. Through this arrangement, when the regulating bolt 91 is mated with the mounting hole 2, the occurrence of circumferential rotation of the regulating bolt 91 with respect to the mounting hole 2 can be avoided, enabling a more stable mating and connection therebetween.

As shown in FIG. 3, since there are many sharp corners at the flange 3 surrounding the mounting hole 2 and stress easily concentrates on the sharp turns at these corners, the area is most susceptible to cracks. Therefore, rounded structures 31 are arranged at all the corners of the flange 3. The arrangement of the rounded structures can avoid the stress concentration initially occurred to the flange 3 effectively and at the same time also makes the surface of the flange 3 more flat, avoiding hurting operators' hands by some burrs or sharp edges at the corners.

Figure 7:
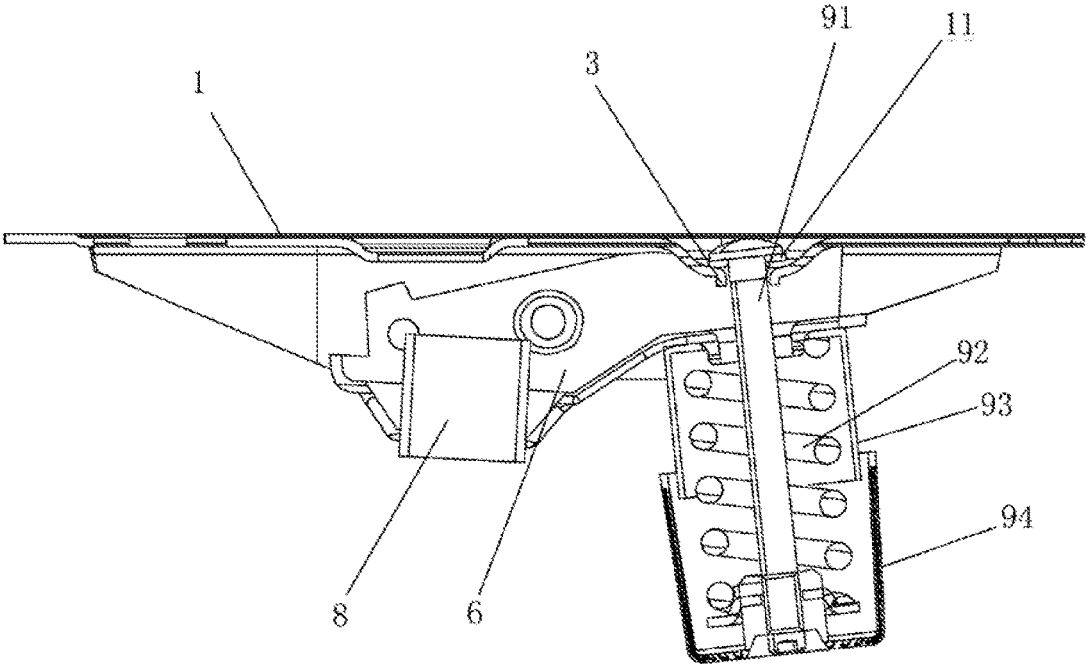
FIG. 7 is a cross section view of the example chair tray.

As shown in FIG. 7, the present chassis mounting structure refers to the mounting structure between the chassis and the regulating bolt 91. A nylon washer 11 is arranged between the head of the regulating bolt 91 and the chassis. The regulating bolt 91 passes through the nylon washer 11 and the mounting hole 2 of the chassis in turn.

Through this arrangement, on the one hand a nylon washer 11 is arranged at the connection between the chassis and the regulating bolt 91. Since the screw head of the regulating bolt 91 comes into direct contact with the bumps 5 of the chassis body 1 as the chair is being leant, wear is more easily to occur after long-term use and furthermore the area in the vicinity of the mounting hole 2 of the chassis body 1 is more susceptible to cracks, causing potential safety hazard. Nylon material has high mechanical strength, good toughness, higher tensile and compressive strength and at the same time its fatigue resistance is outstanding and it is corrosion resistant and wear resistant, therefore by arranging the nylon washer 11, a well protection can be achieved. As a result, utilizing the buffering and high wear resistance of plastic, the connecting structure between the regulating bolt 91 and the chassis avoids the direct contact of the screw head of the regulating bolt 91 with the chassis body 1, and avoids the occurrence of cracks to the chassis body 1. As such, it is more smooth for the chassis below 3 mm to pass the back pad fatigue test in the BIFMA standard at the same time.

Figure 4:
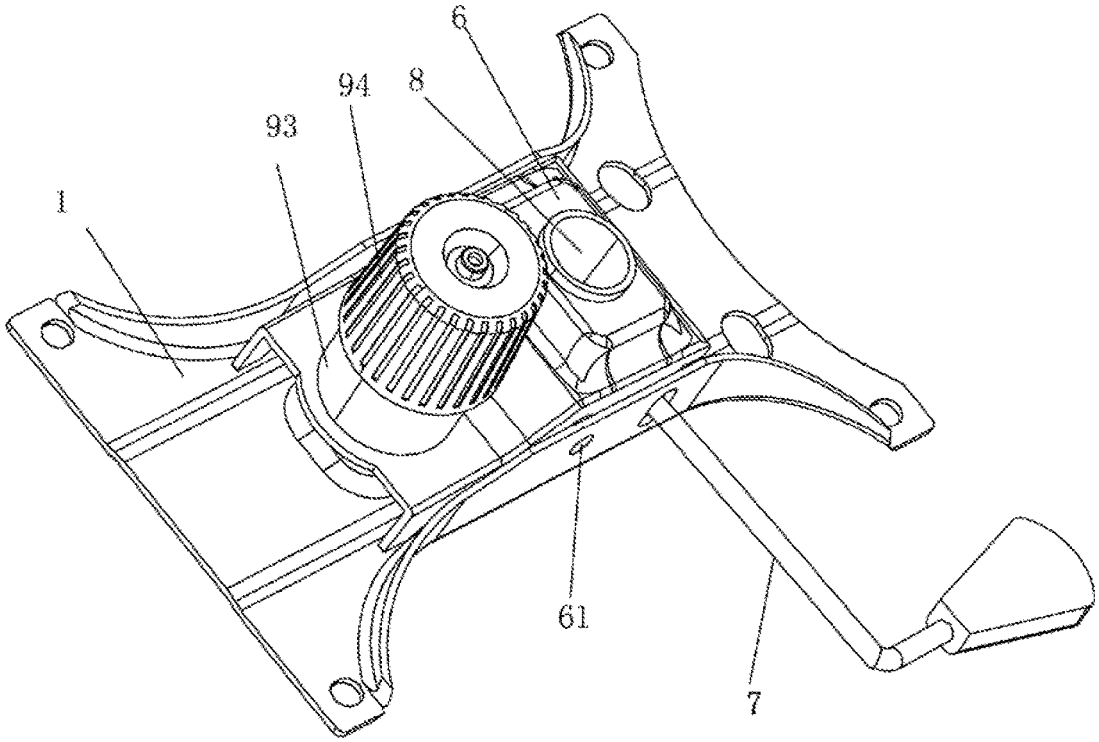
FIG. 4 is a structural schematic diagram of the example chair tray.
Figure 5:
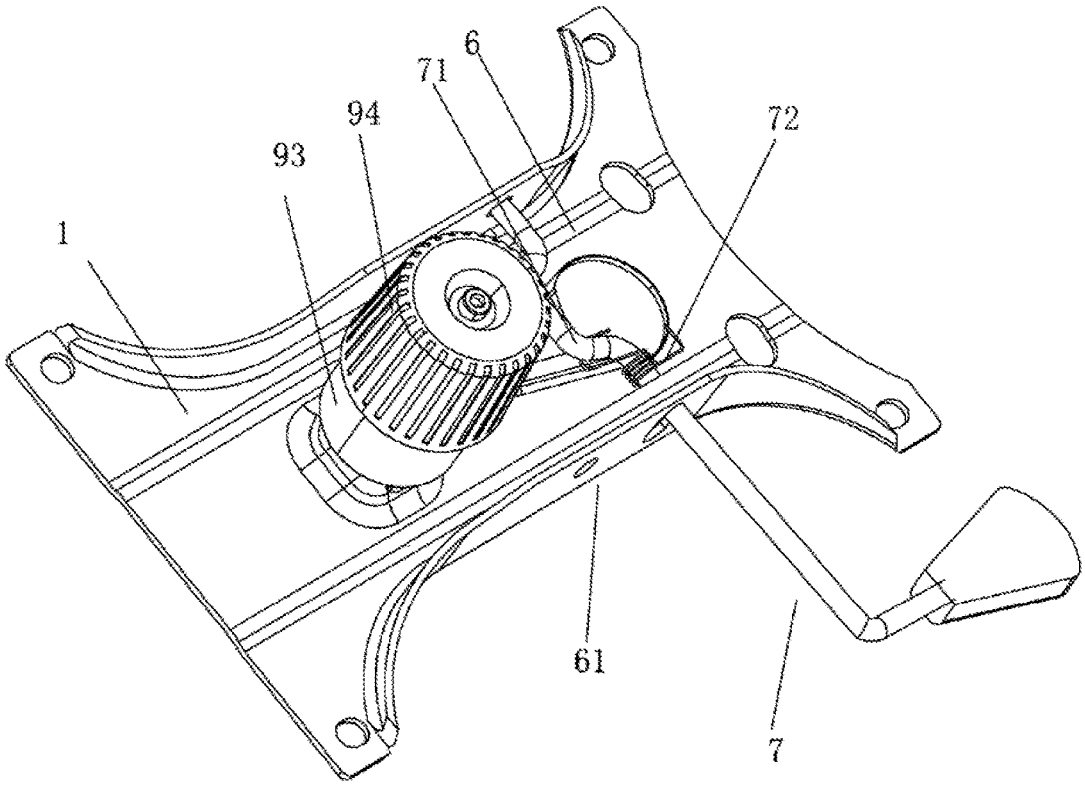
FIG. 5 is a structural schematic diagram of the example chair tray eliminating the middle plate.

As shown in FIGS. 4-5, a chair tray comprises a middle plate 6 and a rotary rod 7. The middle plate 6 is arranged with a rotary shaft 61 therethrough, by which it is connected with the chassis. The middle plate 6 is arranged with a via 8 thereon for a gas spring to go through. The rotary rod 7 is arranged with a bend part 71 thereon for linking the gas spring. The rotary rod 7 is arranged with a reset torsional spring 72 thereon that holds the bend part 71 against the gas spring.

The addition of other structures is omitted and the internal space is saved by arranging the bend part 71 directly on the rotary rod 7 and utilizing the linkage between the bending on the rotary rod 7 and the gas spring, thus creating a simple structure. The resilience of the torsional spring can hold the rotary rod 7 tightly against the gas spring, which ensures that the rotary rod 7 does not rotate freely as the chair vibrates and avoids noise caused by the rotation and then collision of the rotary rod 7. Also, holding the rotary rod 7 against the gas spring reduces the number of the hit by the rotary rod 7 to the gas spring, which makes a higher level of safety and prolongs the lifetime of the equipment. As the torsional spring covers a small space, it can be mounted on the rotary rod 7 directly and the internal space of the middle plate is spacious.

Figure 6:
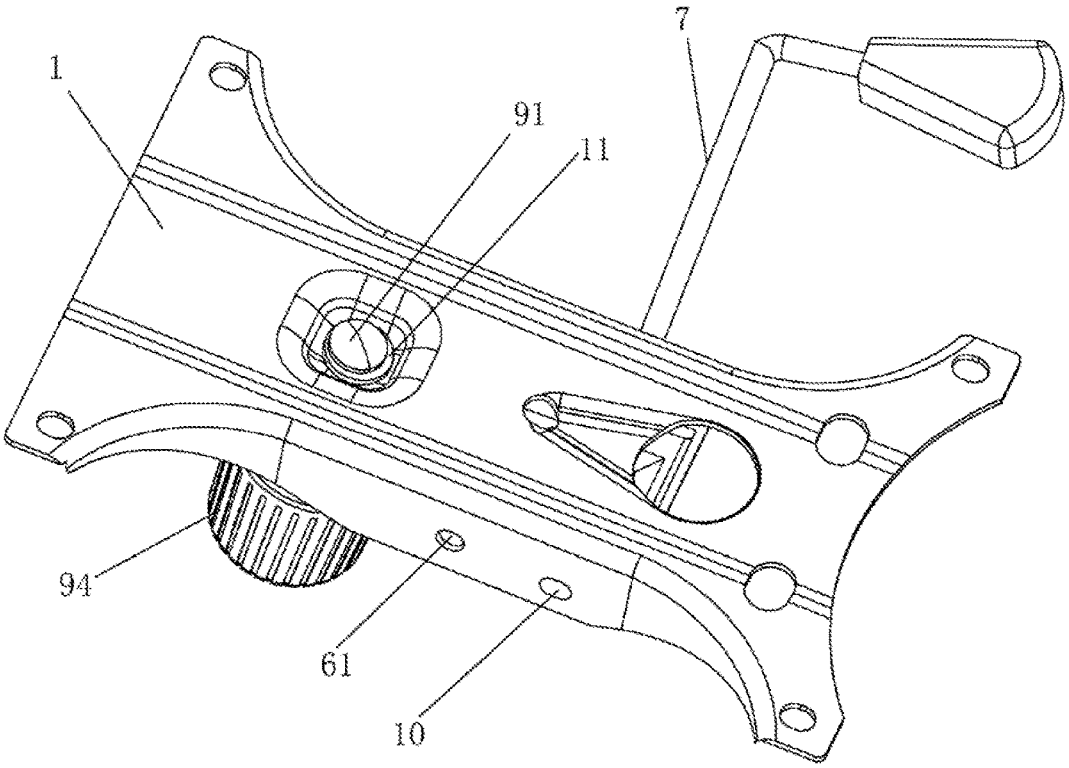
FIG. 6 is a structural schematic diagram of the example chair tray from another perspective.

As shown in FIGS. 5 and 6, the rotary rod 7 runs through the middle plate 6 at its end. The sidewall of the chassis is arranged with limiting holes 10 thereon corresponding with the rotary rod 7.

The chair needs to have different states during use for different occasions. For example, the chair can be leant in order to enhance the level of comfort in leisure time usually while it is not suitable to be leant backward in some formal occasions like meetings, etc. Therefore, the arrangement of limiting holes 10 on the sidewall of the chassis can enable people to make an adjustment according to their different needs during use. When the rotary rod 7 is pushed inward to the extent that its end is mated with the limiting hole 10, the locking function is achieved, which enables the chair not to be leant any more. When the rotary rod 7 is pulled outward to the extent that its end is detached from inside the limiting hole 10, the chair can achieve the function of leaning backward. The operation is simple and convenient and makes the chair more applicable.

As shown in FIG. 7, the mounting hole 2 is arranged with the regulating bolt 91 therethrough, on which an elastic element and a regulating knob 94 are sleeved. The elastic element is a spring 92. The regulating knob 94 is in threaded connection with the regulating bolt 91 and compresses the spring 92 tightly.

Through this arrangement, the spring 92 is compressed tightly by the regulating knob 94, thereby enabling the regulation of the preload of the spring 92 by rotating the regulating knob 94 and furthermore achieving the regulation of the force that the spring 92 acts to reset the leant chair. People can regulate for suitable reset force according to their different needs during use so as to enhance the level of comfort. The arrangement is applicable to different groups of people and has wider applicability. Additionally, the spring 92 is wrapped by the regulating knob 94 and the bushing 93 and is isolated from the outside, which can prolong the lifetime of the spring 92 and avoid the occurrence of rust that influences the use effect. At the same time, the regulating means achieves a simple structure without structures like worm wheel and worm, etc., which can reduce the cost to a very large extent.

Figure 8:
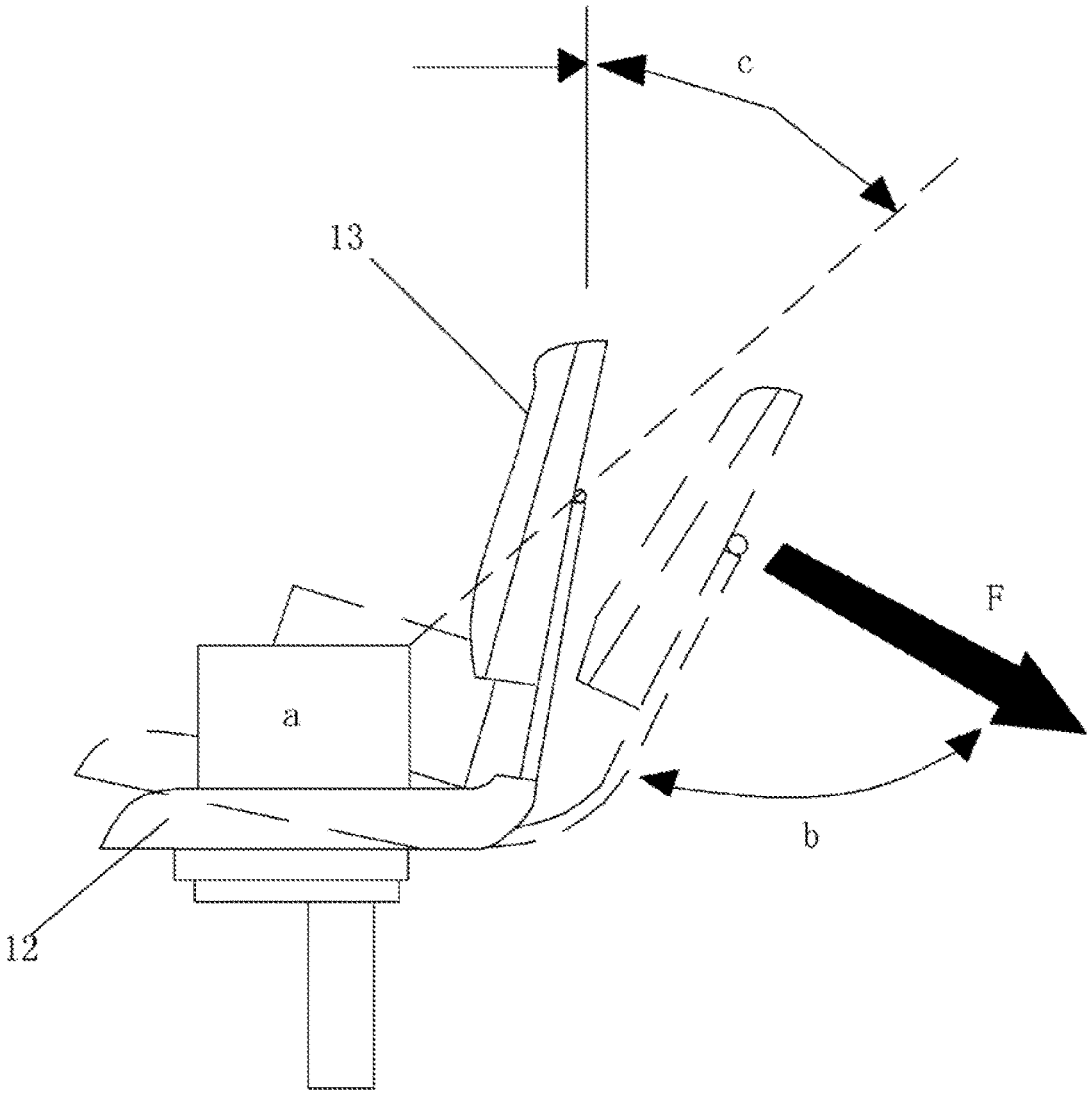
FIG. 8 is a structural schematic diagram of the back pad fatigue test.

As shown in FIG. 8, what is depicted is a structural schematic diagram of the back pad fatigue test that comprises a chair body. A weight a giving a force in the vertical direction to the chair body is placed on a chair cushion 12 of the chair body. The weight a weights 225 pounds. At the same time, a tensile force F tilting backward is given to the back 13. The tensile force F is 100 pounds and the angle formed between the tensile force F and the back 13 is b, where b is 90°±10°. The back 13 rotates by c (c>30°). In this test, b is 90° and c is 32°. Repeat like this so that the chair body makes a constant leaning cycle and count the number of cycles. Observe and record at which cycle cracks occur to the chassis body 1, thereby achieving the back pad fatigue test.

Specific test data is as follows:

| Product name | Product thickness (mm) | Flange | Bump | Nylon washer | Cycle times limit (ten thousand times) |
|---|---|---|---|---|---|
| chassis | 3 | no | no | no | 33 |
| chassis | 2.8 | no | no | no | 20 |
| chassis | 2.5 | no | no | no | 12 |
| chassis | 2.2 | no | no | no | 6 |
| chassis | 3 | yes | no | no | 77 |
| chassis | 2.8 | yes | no | no | 65 |
| chassis | 2.5 | yes | no | no | 55 |
| chassis | 2.2 | yes | no | no | 30 |
| chassis | 3 | yes | yes | no | 80 |
| chassis | 2.8 | yes | yes | no | 70 |

-continued

| Product name | Product thickness (mm) | Flange | Bump | Nylon washer | Cycle times limit (ten thousand times) |
|---|---|---|---|---|---|
| chassis | 2.5 | yes | yes | no | 58 |
| chassis | 2.2 | yes | yes | no | 32 |
| chassis | 3 | yes | yes | yes | 89 |
| chassis | 2.8 | yes | yes | yes | 76 |
| chassis | 2.5 | yes | yes | yes | 63 |
| chassis | 2.2 | yes | yes | yes | 35 |

(Note: all the above cycle times limits are integer numbers that are rounded.)

The following conclusions can be drawn by comparing the above test data. Whether there is a flange 3 has the biggest influence on the structural strength and the fatigue strength of the chassis, and the second biggest influence comes from the nylon washer 11 and the bump 5. Moreover, in a case that there is no flange 3, nylon washer 11 and bump 5 and when the thickness of the chassis is 3 mm, the chassis barely breaks the 300 thousand times requirement by the back pad fatigue test in the BIFMA standard, while in a case that the thickness of the chassis is below 3 mm, it obviously cannot reach the 300 thousand times requirement. However, in a case that there is a flange 3, the structural strength and the fatigue strength of the chassis are enhanced to a very large extent. In a case that there is a flange 3 and the thickness of the chassis is 3 mm, the chassis can easily pass the 300 thousand times requirement, and when the thickness of the chassis is below 3 mm, it can still reach the 300 thousand times requirement. When the thickness of the chassis is 2.2 mm, the chassis can barely reach the 300 thousand times requirement, but such thickness is susceptible to unforeseen circumstances during test that cause the chassis substandard as a result of the occurrence of defective products, resulting in a lot waste. Therefore, it is most appropriate to select the thickness of 2.5 mm and when the thickness is 2.5 mm, the chassis can be ensured to pass the standard test in a case that there is no bump 5 and nylon washer 11. Therefore, the mechanical strength and the fatigue strength are more guaranteed and the cycle times limit can be increased after adding the nylon washer 11 during the chair test.

Since the flange 3 is formed by punching, the thickness of the flange 3 is the same as that of the chassis, but the flange 3 should not be too high because when the flange 3 is getting higher, the aperture of the mounting hole 2 is getting bigger. A too big aperture easily influences the overall strength of the chassis, therefore it is more appropriate that the flange is 2-3 mm high. Preferably, both the height of the flange 3 and the thickness of the flange 3 are 2.5, which is the most appropriate case.

Therefore, 2.5 mm thick bottom case can easily pass the back pad fatigue test in the BIFMA standard in a case that there is a flange 3. When compared to the thickness above 3 mm on the market, it reduces production material to a very large extent and saves production cost and has a good market prospect.

The above description is only a preferred implementation of this invention. The scope of protection of the invention is not limited to the above embodiments and claims falling within the idea of this invention all belong to the scope of protection of the invention. It should be noted to those of ordinary skill in the art that many improvements and modifications may be made without departing from the principle of the invention. These improvements and modifications are also to be considered within the scope of protection of the invention.

I claim:

1. A chair chassis, comprising a chassis body (1) that is arranged with a mounting hole (2) thereon for mounting a regulating bolt (91), characterized in that the edge at the position corresponding to the mounting hole (2) of the chassis body (1) is arranged with a flange (3);

wherein the flange (3) is arranged on a lower surface of the chassis;

a position on an outer surface of the chassis body (1) and corresponding to the mounting hole (2) is depressed and forms a lower projection (4) in an inner wall of the mounting hole (2);

the upper surface of a lower depression of chassis body (1) is arranged with bumps (5) that are arranged at an interval in the direction of the chassis width and distributed at two sides of the mounting hole (2), wherein the surface of the bump (5) is a cambered face; and rounded structures (31) are arranged at corners of the flange (3).

2. A forming method of the flange (3) and the bumps (5) of claim 1, characterized in that the flange (3) is formed by forward punching at the position corresponding to the mounting hole (2) on the upper surface of the chassis.

3. The forming method according to claim 2, characterized in that the bumps (5) are formed by reverse punching on the lower surface of the chassis.

4. A connecting structure between the chassis and the regulating bolt (91) of claim 1, characterized in that a nylon washer (11) is arranged between the head of the regulating bolt (91) and the chassis, wherein the regulating bolt (91) passes through the nylon washer (11) and the mounting hole (2) of the chassis in turn.

5. A chair tray with the connecting structure of claim 4, characterized in that an elastic element and a regulating knob (94) are sleeved on the regulating bolt (91), wherein the regulating knob (94) is in threaded connection with the regulating bolt (91), such that when the regulating knob (94) is rotated, the elastic element is compressed to achieve the regulation of the leaning reset force.

6. The chair tray according to claim 5, characterized in that the chair tray also comprises a middle plate (6) and a rotary rod (7), wherein the middle plate (6) is arranged with a rotary shaft (61) therethrough, by which it is connected with the chassis, the middle plate (6) is arranged with a via (8) thereon for a gas spring to go through, the rotary rod (7) is arranged with a bend part (71) thereon for linking the gas spring, the rotary rod (7) is arranged with a reset torsional spring (72) thereon that holds the bend part (71) against the gas spring.

7. The chair tray according to claim 6, characterized in that the rotary rod (7) runs through the middle plate (6) at its end, wherein the sidewall of the chassis is arranged with limiting holes (10) thereon corresponding with the rotary rod (7).

* * * * *